US008820792B2

(12) United States Patent
Lee et al.

(10) Patent No.: US 8,820,792 B2
(45) Date of Patent: Sep. 2, 2014

(54) INSIDE LEAFLET OF BOOK

(76) Inventors: Sang-Mok Lee, Busan-si (KR); Sin-Ho Lee, Busan-si (KR); Byeong-Ho Seong, Busan-si (KR)

( * ) Notice: Subject to any disclaimer, the term of this patent is extended or adjusted under 35 U.S.C. 154(b) by 113 days.

(21) Appl. No.: 12/815,482

(22) Filed: Jun. 15, 2010

(65) Prior Publication Data

US 2011/0175342 A1 Jul. 21, 2011

(30) Foreign Application Priority Data

Jan. 19, 2010 (KR) ..... 10-2010-0004654
Apr. 30, 2010 (KR) ..... 10-2010-0040988

(51) Int. Cl.

| | |
|---|---|
| ***B42D 1/00*** | (2006.01) |
| ***B42D 19/00*** | (2006.01) |
| ***B42D 15/00*** | (2006.01) |
| ***B42F 13/00*** | (2006.01) |
| ***G09F 23/10*** | (2006.01) |
| ***B42D 13/00*** | (2006.01) |

(52) U.S. Cl.

CPC ..... *G09F 23/10* (2013.01); *B42D 1/002* (2013.01); *B42D 13/00* (2013.01)

USPC ..... 281/9; 281/2; 281/5; 281/7; 281/10; 281/12; 281/14; 283/56; 283/61; 283/62; 283/67; 283/82; 402/79

(58) Field of Classification Search

USPC ..... 281/2, 5, 7, 9, 10, 12, 14, 19.2; 283/56, 283/61, 62, 67, 74, 82; 402/79

See application file for complete search history.

(56) References Cited

U.S. PATENT DOCUMENTS

| | | | | |
|---|---|---|---|---|
| 3,895,220 | A * | 7/1975 | Nelson et al. | 283/82 |
| 6,672,785 | B1 * | 1/2004 | O'Hara et al. | 402/79 |
| 7,293,933 | B1 * | 11/2007 | Baldwin | 402/79 |
| 2010/0322701 | A1 * | 12/2010 | Butterfield et al. | 402/19 |

FOREIGN PATENT DOCUMENTS

| | | |
|---|---|---|
| JP | 2007-045138 | 2/2007 |
| JP | 2009-145699 | 7/2009 |
| KR | 20-0188310 | 7/2000 |

(Continued)

OTHER PUBLICATIONS

International Search Report issued on Feb. 21, 2011, in corresponding International Application No. PCT/KR2010/003755 (3 pages).

*Primary Examiner* — Shelley Self
*Assistant Examiner* — Justin V Lewis
(74) *Attorney, Agent, or Firm* — NSIP Law

(57) ABSTRACT

An inside leaflet of a book is provided which is bond-bound with pages of the book to provide an advertisement. The inside leaflet includes an advertisement printed part and a binding part. Catchphrases or illustrations for advertisement are printed on at least one side of the advertisement printed part. The binding part is configured to be bound with the pages along an edge of the inside leaflet such that the binding part has less binding portions than those of the pages in order to leave no traces or marks when the inside leaflet is detached from the book. Accordingly, since the inside leaflet is able to be bound to pages of various kinds of books and easily removed from the books without leaving any traces or marks in the books, the inside leaflet contributes to extension of the application range of advertisements and improvement of advertisement efficiency.

1 Claim, 5 Drawing Sheets

(56) References Cited

FOREIGN PATENT DOCUMENTS

| | | |
|---|---|---|
| KR | 2003-0067808 | 8/2003 |
| KR | 20-0340934 | 2/2004 |
| KR | 20-0411690 | 3/2006 |
| KR | 10-0929156 | 11/2009 |

* cited by examiner

INSIDE LEAFLET OF BOOK

CROSS-REFERENCE TO RELATED APPLICATION(S)

This application claims the benefit under 35 U.S.C. §119 (a) of Korean Patent Applications No. 10-2010-0004654, filed on Jan. 19, 2010, and No. 10-2010-0040988, filed on Apr. 30, 2010, the entire disclosure of each of which is incorporated herein by reference for all purposes.

BACKGROUND

1. Field

The following description relates to an inside leaflet of a book, which is bound with pages of the book to provide an advertisement.

2. Description of the Related Art

A leaflet is a paper based advertisement on which catchphrases or illustrations for advertisement are printed. Leaflets may be distributed in sheets or together with printings such as newspapers by being inserting therein. For example, a leaflet may be bond-bound with pages of a magazine, such as a monthly magazine or a daily magazine, and distributed together with the magazine. Such an inside leaflet included in a magazine may be detached from the magazine to be used or discarded. When the inside leaflet is detached from the magazine, the inside leaflet may remain certain traces or marks on the corresponding page of the magazine since the inside leaflet has been bond-bound with the pages of the magazine.

In order to eliminate the problem, a method has been proposed which makes a perforated line on a leaflet to cleanly detach the leaflet from a magazine along the perforated line. However, in this case, the page from which the leaflet has been detached will still remain in the magazine, and if the magazine is a valuable magazine, such a remaining page portion may cause readers to be unsatisfied.

As such, since conventional inside leaflets have a problem, there is limitation in applying such conventional inside leaflets to books, such as novels, examination books, reference books and the like, which tend to be kept for a long time. There is the case where a reader who bought a book, such as a novel, an examination book or a reference book, in which an inside leaflet has been bond-bound, removes the inside leaflet on determining that the leaflet is not needed.

In this case, since the inside leaflet has been bond-bound with pages of the book, the removal of the inside leaflet from the corresponding page will remain certain traces or marks on the page. For this reason, customers may be put off buying books including inside leaflets, and readers may be reluctant to view advertisements inside books. Consequently, due to the problem, the application range of inside leaflets may be limited and advertisement efficiency may be lowered.

SUMMARY

The following description relates to an inside leaflet of a book, which is bound with pages of various kinds of books and can be removed from the books without leaving any traces or marks in the books, thereby capable of extending the application range of advertisement and raising advertisement efficiency.

In one general aspect, there is provided an inside leaflet of a book, which is bond-bound with pages of the book to provide an advertisement, the inside leaflet including: an advertisement printed part having printed on one side a catchphrase or an illustration for advertisement; and a binding part configured to be bound with the pages along an edge of the inside leaflet such that the binding part has less binding portions than those of the pages in order to leave no traces or marks when the inside leaflet is detached from the book.

Therefore, even when the inside leaflet is bond-bound to a page of a book, the inside leaflet may be cleanly removed from the page without leaving any traces or marks on the page. Accordingly, the inside leaflet can be inserted into various kinds of books including magazines, without lowering customers' interest and causing a reluctance against inside advertisement of books. Furthermore, the inside leaflet does not deteriorate the possession value of a book. Consequently, the inside leaflet contributes to extension of the application range of leaflets and improvement of advertisement efficiency.

Other features and aspects will be apparent from the following detailed description, the drawings, and the claims.

Figure 1:
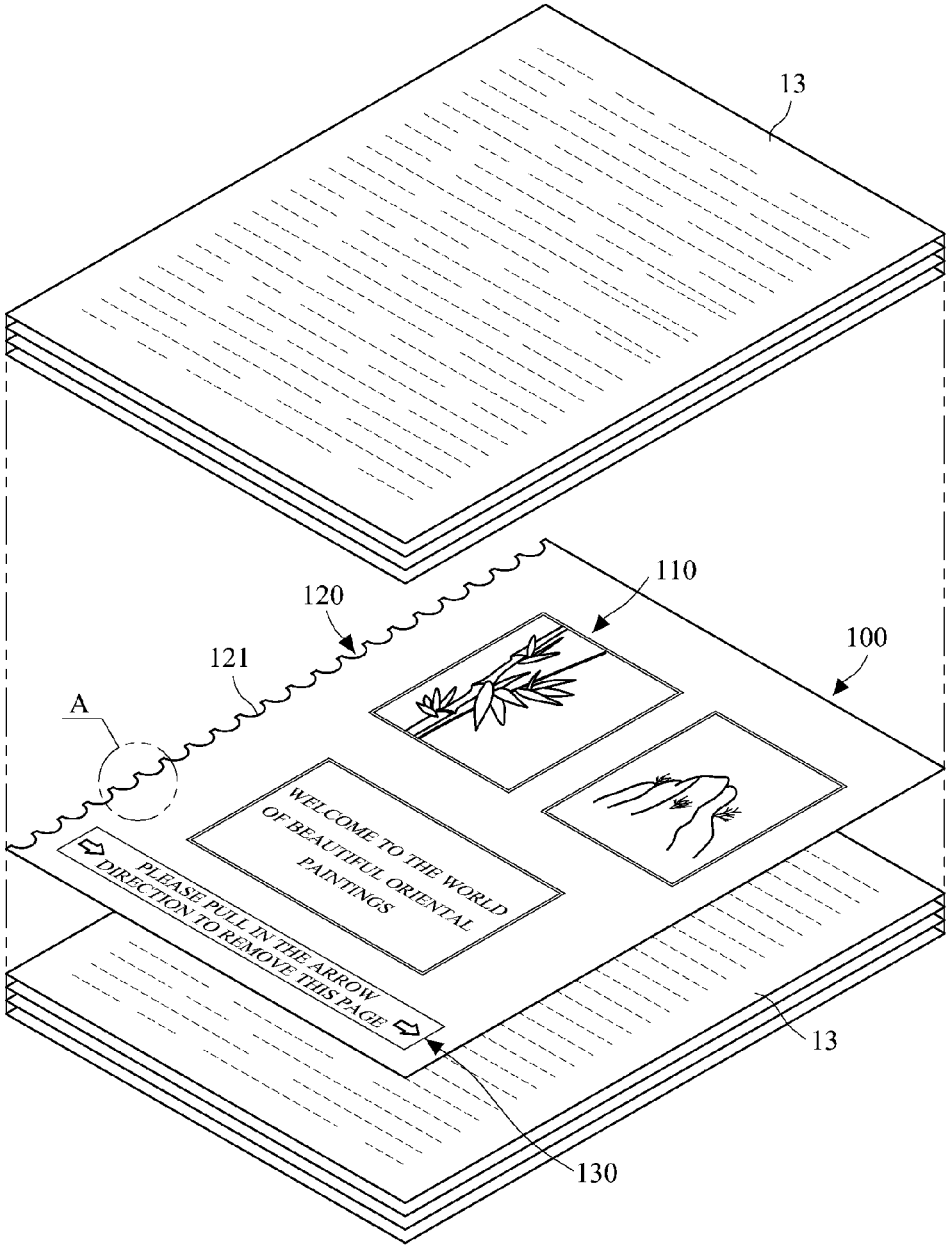
FIG. 1 is an exploded, perspective view for explaining an example where an inside leaflet is according to an example is applied to a book.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

Figure 2:
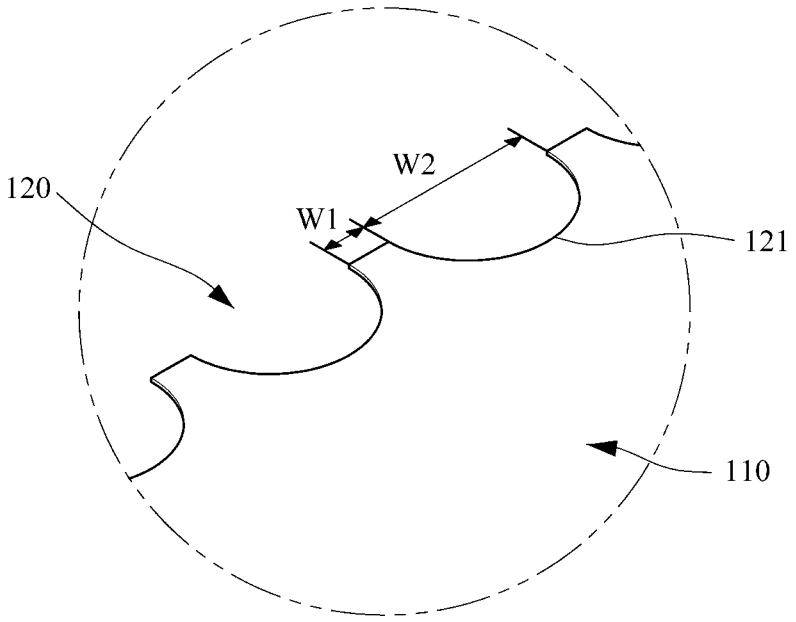
FIG. 2 is an enlarged view of an area A illustrated in FIG. 1.
Figure 3:
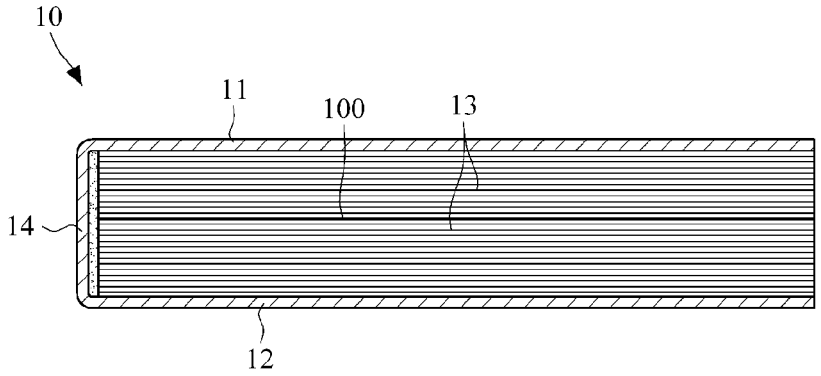
FIG. 3 is a cross-sectional view of a book into which the inside leaflet and pages illustrated in FIG. 1 are bond-bound.
Figure 4:
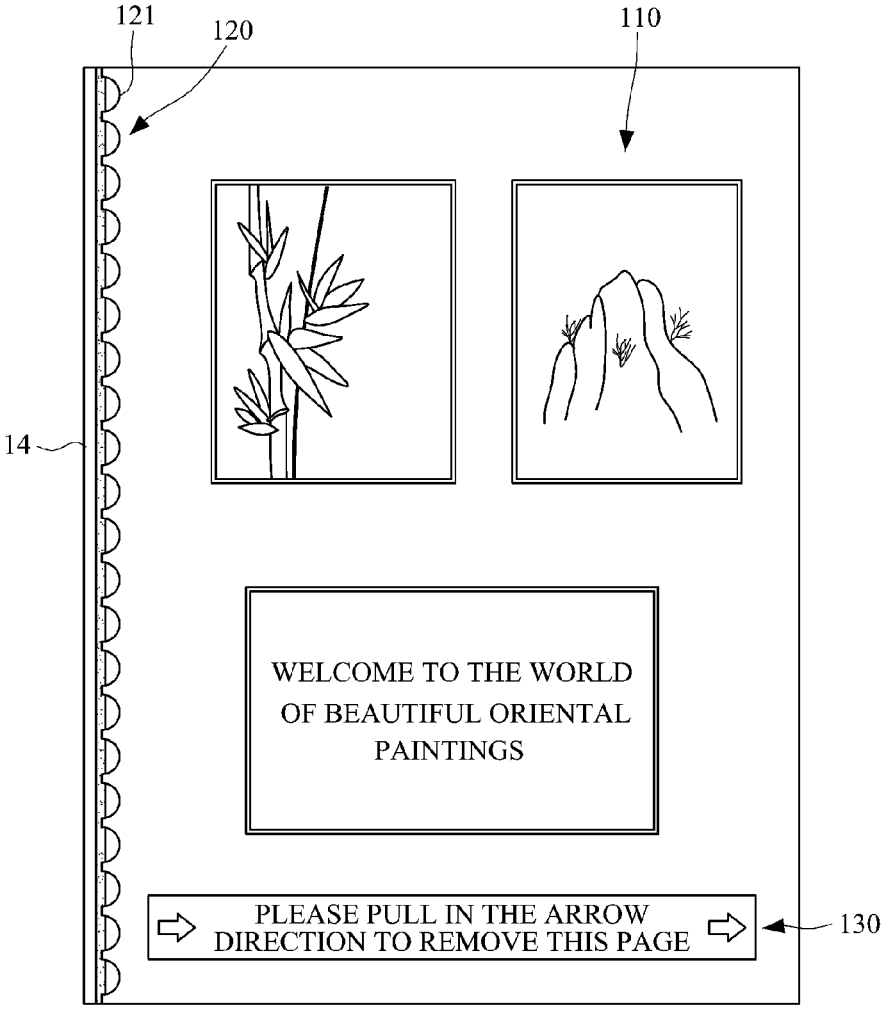
FIG. 4 is a plane view of the inside leaflet illustrated in FIG. 1.

FIG. 1 is an exploded, perspective view for explaining an example where an inside leaflet 100 according to an example is applied to a book, and FIG. 2 is an enlarged view of an area A illustrated in FIG. 1. FIG. 3 is a cross-sectional view of a book 10 into which the inside leaflet 100 and pages 13 illustrated in FIG. 1 are bond-bound, and FIG. 4 is a plane view of the is inside leaflet 100 illustrated in FIG. 1.

Referring to FIGS. 1 through 4, the book 10 to which the inside leaflet 100 is applied may be a novel, an examination book, a reference book or the like that tend to be kept for a long time. The book 10 is composed of a front cover 11, a back cover 12, pages 12 containing content of the book 10 and a backbone 14. The pages 13 of the book 10 are arranged between the front cover 11 and the back cover 12 and bond-bound with the front and back covers 11 and 12 against the backbone 14.

The inside leaflet 100 is bond-bound with the pages 13 of the book 10 to provide an advertisement to a reader who read the book 10. That is, when a reader reads the book 10, the inside leaflet 100 inserted between the pages 13 is exposed to the reader, thereby providing an advertisement effect. The inside leaflet 100 includes an advertisement printed part 110 having printed on at least one side catchphrases or illustrations for advertisement, and a binding part 120 configured to be bound with the pages 12 along an edge of the inside leaflet 110. The inside leaflet 100 may be the same size as the pages 13 or a size smaller than the pages 13.

The binding part 120 is formed to have less binding portions than those of the pages 13 bound against the backbone 14, so as not to leave certain traces or marks when a reader detaches the inside leaflet 100 from the book 100 after viewing the inside leaflet 100. Meanwhile, a conventional binding method in which a binding part of an inside leaflet has the same binding portion as other pages may leave certain traces or marks inside a book when the inside leaflet is removed from the book.

However, if the binding portions of the binding part 120 of the inside leaflet 100 are formed to be smaller than those of the other pages 13 in order to leave no traces or marks when the inside leaflet 100 is removed from the book 10, portions at which the inside leaflet 100 is bonded with the pages 13 are also reduced so that the inside leaflet 100 can be clearly removed from the book 10 without remaining any traces or marks in the book 10. Accordingly, the is inside leaflet 100 can be inserted into pages of various kinds of books as well as magazines, neither deteriorating customers' interest nor causing a reluctance against inside advertisements of books. In addition, the value of the book 10 can also be maintained. Consequently, the inside leaflet 100 contributes to extension of the application range of leaflets and improvement of advertisement efficiency.

Meanwhile, the binding part 120 may be formed with an arbitrary shape as long as it can be easily removed from the book 10 without remaining any traces or marks in the book 10. For example, the binding part 120 may include grooves 121 that are formed with the same shape and cut out at regular intervals along an edge of the inside leaflet 110. Different shapes may also be employed. Accordingly, portions at which the inside leaflet 100 is bonded with the pages 13 are aligned at regular intervals so that no traces or marks remain when the inside leaflet 100 is detached from the book 10.

In order to further improve the effect for easy detachment without making any traces or marks, the width W1 (hereinafter, referred to as an end width W1) between grooves 121 may be formed to be narrower than the width W2 (hereinafter, referred to as an opening width W2) of each groove 121. Specifically, a ratio W1/W2 of the end width W1 to the opening width W2 may be set to 0.2 to 0.3. For example, the opening width W2 of each groove 121 may be set to 8 mm and the end width W1 between the grooves 121 may be set to 2 mm. In addition, each groove 121 may have a semicircle shape.

Figure 5:
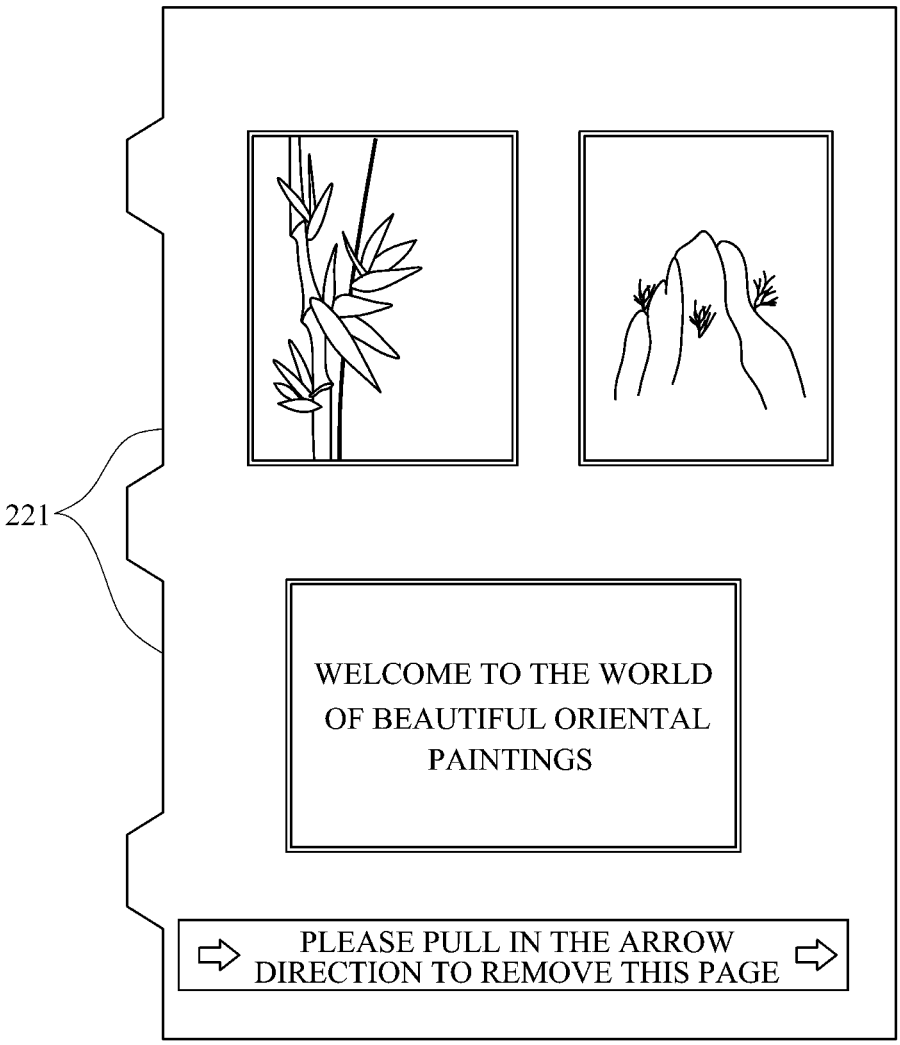
FIG. 5 is a modification example of the inside leaflet illustrated in FIG. 1.

As another example, as illustrated in FIG. 5, grooves 221 each having a trapezoid shape may be formed. The example of a trapezoid is not intended to be limiting, and other shapes are contemplated. In other words, like the grooves 121 and 221, the shape of grooves to be formed in an inside leaflet may be various as long as the inside leaflet leaves no traces or marks when being removed from a book.

Meanwhile, a notice for helping a reader detach the binding part 120 from the pages 13 is printed on the advertisement printed part 110 so that the reader can easily remove the inside leaflet 100 from the book 10.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An inside leaflet of a book, which is bond-bound with pages of the book to provide an advertisement, the inside leaflet comprising:

an advertisement printed part having printed on one side a catchphrase or an illustration for advertisement;

an instruction printed part on the same side that provides a direction to remove the leaflet from the book;

a binding part including an outermost edge of the leaflet that is configured to be bond-bounded to a backbone of the book such that when bond-bounded only a very edge of the outermost edge of the binding part physically and directly contacts an adhesive applied to an entire inner surface of the backbone;

wherein the outermost edge of the leaflet comprises less binding portions than outermost edges of the pages such that when the leaflet is detached from the backbone of the book no traces or marks are left by the inside leaflet;

the very edge of the outermost edge of the binding part is disposed along a line that is farthest from a line corresponding to a middle of the leaflet;

the binding part comprises a plurality of grooves that are formed with the same shape and are cut out at regular intervals along the outermost edge of the inside leaflet; and each groove comprises a semicircle shape and a ratio W1/W2 of the end width W1 to the opening width W2 that is 0.2 to 0.3.

* * * * *